US008232927B2

(12) United States Patent
Yoshioka

(10) Patent No.: US 8,232,927 B2
(45) Date of Patent: Jul. 31, 2012

(54) ANTENNA ELEMENT

(75) Inventor: Hiroki Yoshioka, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 435 days.

(21) Appl. No.: 12/372,249

(22) Filed: Feb. 17, 2009

(65) Prior Publication Data

US 2009/0207089 A1 Aug. 20, 2009

(30) Foreign Application Priority Data

Feb. 18, 2008 (JP) ..... P2008-35559

(51) Int. Cl.
*H01Q 1/24* (2006.01)
*H01Q 13/10* (2006.01)

(52) U.S. Cl. ..... 343/846; 343/702; 343/767

(58) Field of Classification Search ..... 343/702, 343/746, 899, 700 MS, 846, 767
See application file for complete search history.

(56) References Cited

U.S. PATENT DOCUMENTS

| | | | | |
|---|---|---|---|---|
| 6,650,294 | B2 * | 11/2003 | Ying et al. | 343/700 MS |
| 7,825,859 | B2 * | 11/2010 | Teshima | 343/700 MS |
| 2003/0076268 | A1 * | 4/2003 | Tarvas et al. | 343/702 |
| 2003/0206136 | A1 | 11/2003 | Chen | |
| 2005/0259042 | A1 * | 11/2005 | Lee | 345/63 |
| 2007/0109200 | A1 | 5/2007 | Su | |
| 2007/0247372 | A1 | 10/2007 | Huang | |
| 2008/0030407 | A1 * | 2/2008 | Hung et al. | 343/700 MS |
| 2008/0122720 | A1 | 5/2008 | Liao | |
| 2009/0073746 | A1 * | 3/2009 | Ng et al. | 365/154 |

FOREIGN PATENT DOCUMENTS

| | | |
|---|---|---|
| JP | 2003-273638 | 9/2003 |
| JP | 2003-283233 | 10/2003 |
| JP | 2003-304114 | 10/2003 |
| JP | 2003-304115 | 10/2003 |
| JP | 2005-94437 | 4/2005 |
| JP | 2005-175846 | 6/2005 |
| JP | 2006-186969 | 7/2006 |
| WO | WO 2007/021247 | 2/2007 |

OTHER PUBLICATIONS

Hattori et al.; "Broadband Oval Ring Antenna"; General Assembly of IEICE; B-1-104, Osaka, Japan, Mar. 2005.
Hattori et al.; "Broadband Oval Ring Antenna Second Report" Society Assembly of IEICE B-1-82; Hokkaido, Japan, Sep. 2005.
Hattori, et al.; "Broad Band Oval Ring Antenna Third Report"; General Assembly of IEICE; B-1-165, Tokyo Japan; Mar. 2006.
Japanese Office Action with English translation.
Japanese Office Action.

* cited by examiner

*Primary Examiner* — Jacob Y Choi
*Assistant Examiner* — Hasan Islam
(74) *Attorney, Agent, or Firm* — Whitham, Curtis, Christofferson & Cook, PC

(57) ABSTRACT

An antenna element is disclosed. A conductive plate is adapted to be electrically connected to an electric ground, and has a first edge. A second edge opposes the first edge and is formed with a first slit elongated in a first direction. A third edge intersects the first edge. A recessed part intersects the first edge and the third edge. A conductive member elongates from the second edge in the first direction.

7 Claims, 8 Drawing Sheets

ANTENNA ELEMENT

BACKGROUND

The present invention relates to an antenna element and, more particularly, to a broadband antenna element incorporated in a portable electronic device main unit or a module, or the like, connected to an extension terminal (an optional terminal) of a portable electronic device.

A UWB (Ultra-Wide Band) technique represents ultra wide band wireless communication as its name signifies. UWB is defined as a wireless technique that occupies 25% or more of a center frequency or a bandwidth of 1.5 GHz or more. In a word, the UWB technique is a technique that establishes communication by use of a short pulse in an ultra wide band (1 ns or less in normal times), thereby effecting a revolution in wireless transmission.

A definitive difference between the related-art wireless technique and the UWB technique can be said to lie in presence/absence of a carrier wave. Under the related-art wireless technique, a sinusoidal wave of a certain frequency, which is called a carrier wave, is modulated by means of various methods, and data are transmitted or received. In contrast, the carrier wave is not used under the UWB technique. The UWB technique uses a short pulse in an ultra wide band as described in connection with the definition of the UWB technique.

The UWB technique uses an ultra wide frequency band, as its name signifies. In the meantime, the related-art wireless technique uses only a narrow frequency band. This is because a radio wave can be more utilized as the frequency band becomes narrower. The radio wave is a finite resource. The reason why the UWB technique gains attention despite its ultra wide band is output energy achieved at respective frequencies. Although the UWB technique uses a wide frequency band, outputs achieved at respective frequencies are very small. Since outputs achieved under the UWB technique are buried in noise, the UWB technique can be said to have the very low potential of causing interference with another wireless communication. The FCC (Federal Communications Commission) in US has granted permission for UWB transmission because UWB transmission can be performed in a legally-prescribed manner within a range from 3.1 GHz to 10.6 GHz at a limited transmission output of −4.1 bBmMHz.

An antenna basically utilizes a resonance phenomenon. A resonance frequency of an antenna is determined by a length of the antenna. However, in an UWB including many frequency components, it is difficult to cause the antenna to perform resonance in an UWB. Consequently, the wider the frequency band of a radio wave desired to be transmitted becomes, designing of the antenna becomes correspondingly harder.

Taiyo Yuden Co., Ltd. has successfully developed an ultra-small ceramic chip antenna measuring 10 mm×8 mm×1 mm for UWB. Since the UWB technique is opened for FCC commercial applications, the technique attracts an attention as the next-generation short-range wireless communication standards. For one thing, there is a chance of simultaneous realization of high-capacity data transmission and low power consumption. For another thing, under the UWB technique, occurrence of interruption is avoided by transmission of a very-low output pulse that is equal to or less than a transmission noise threshold value. By means of development of the antenna, the UWB broadens the duty of a wireless industry from military applications to fields of commercial applications where data belonging to digital devices, such as a PDP (Plasma Display Panel) TV and a digital camera, are linked together at extremely high speed.

Such an UWB antenna can be used for applications, such as Bluetooth® and a wireless LAN (Local Area Network).

The Bluetooth® is an open standard for the advanced technology that implements wireless communication of audio and data within a comparatively-small range among a desktop computer, a notebook computer, a hand-held device, a PDA (Personal Digital Assistant), a portable cellular phone, a printer, a scanner, a digital camera, and a mouse of a computer. Since communication is performed by use of a radio wave in a 2.4 GHz band, which is available everywhere on Earth, under the Bluetooth wireless technique, the technique can be utilized in the world. To put it briefly, the Bluetooth technique obviates the necessity of a cable used for connection of digital peripheral devices, and inconvenience related to cable connection is now a thing of the past.

The word "wireless LAN" signifies a LAN utilizing a transmission channel other than a wired cable, such as a radio wave and infrared radiation.

Various broadband antenna devices have hitherto been known in this field. For instance, Patent Document 1 (JP-A-2003-273638) discloses a broadband antenna device that is tuned for a target frequency characteristic and that can diminish interference originating from unwanted frequency bands and interference to frequency bands other than a target frequency band. According to Patent Document 1, the broadband antenna device has a plane conductor bottom plate and a plane radiation conductor that is used while standing on the surface of the plane conductor bottom plate in a direction crossing the plane conductor bottom plate. A feeding point is positioned on an outer periphery of the plane radiation conductor or its neighborhood. The plane radiation conductor is provided with one or more cutouts that are formed by cutting a portion(s) of the plane radiation conductor.

Patent Document 2 (JP-A-2003-283233) discloses a compact broadband antenna device that addresses problems, such as cost, the purpose of use, and incorporation of an antenna device into equipment and that enables a reduction in manufacturing cost and covers a wide frequency range. According to Patent Document 2, the broadband antenna device has a plane conductor bottom plate and a polygonal plane radiation conductor that is used while standing on the surface of the plane conductor bottom plate in a direction crossing the plane conductor bottom plate. An apex of the polygonal plane radiation conductor is taken as a feeding point.

Patent Document 3 (JP-A-2003-304114) discloses a broadband antenna device that uses a plane radiation conductor as a radiation conductor and that can be miniaturized to a much greater extent. According to Patent Document 3, the broadband antenna device has a plane conductor bottom plate and a plane radiation conductor that is arranged on a surface of the plane conductor bottom plate so as to stand in a direction crossing the plane conductor bottom plate. The plane radiation conductor has a plurality of conductor portions arranged in a direction crossing the plane conductor bottom plate when remaining in an upright position on the surface of the plane conductor bottom plate. The plurality of conductor portions is interconnected by means of a low-conductivity member whose conductivity approximately ranges from 0.1 [/Ωm] to 10.0 [/Ωm].

Patent Document 4 (JP-A-2003-304115) discloses a lower-profile broadband antenna device. According to Patent Document 4, the broadband antenna device has a conductor bottom plate and a radiation conductor, they are connected to each other by means of a feeder line for feeding power and they are arranged in such a way that at least portions of the bottom plate and the conductor oppose each other. A substance whose conductivity achieved in a usable wireless frequency approximately ranges from 0.1 [/Ωm] to 10.0 [/Ωm] is placed at a position where the conductor bottom plate and the radiation conductor face each other.

An antenna device for UWB purpose that enables broadening of a frequency band and enhancement of a frequency characteristic is proposed in Patent Document 5 (JP-A-2005-94437). According to Patent Document 5, the UWB antenna device has a radiation element made up of an upper dielectric substance, a lower dielectric substance, and a conductor pattern sandwiched therebetween. The conductor pattern has a feeding point provided in an essential center of a front surface. The conductor pattern is built from an inverse triangular section, which has a right tapered portion extending from the feeding point to a right side surface at a predetermined angle and a left tapered portion extending from the feeding point to a left side surface at a predetermined angle, and a rectangular portion whose bottom edge contacts an upper edge of the inverse triangular portion. A ground plate, extending within a plane identical with the conductor pattern (a radiation element), is electrically connected to the feeding point of the conductor pattern.

Various thin antennas for UWB purpose that cover frequencies of a UWB from 3.1 GHz to 10.6 GHz have been proposed. For instance, a broadband oval ring antenna whose radiation element is made in an oval shape has been known (see; for instance, Non-Patent Document 1). Further, a broadband oval ring antenna for which an attempt has been made to miniaturize a ground plate has also been known (see; for instance, Non-Patent Document 2). A broadband oval ring antenna whose gain is improved by 9 GHz or more has also been known (see; for instance, Non-Patent Document 3).

[Patent Document 1] JP-A-2003-273638
[Patent Document 2] JP-A-2003-283233
[Patent Document 3] JP-A-2003-304114
[Patent Document 4] JP-A-2003-304115
[Patent Document 5] JP-A-2005-94437
[Non-Patent Document 1] Hattori, Kondo, Yamauchi, Nakano, "Broadband Oval Ring Antenna," General Assembly of IEICE, B-1-104, Osaka, March in 2005.
[Non-Patent Document 2] Hattori, Yamauchi, Nakano, "Broadband Oval Ring Antenna Second Report," Society Assembly of IEICE, B-1-82, Hokkaido, September in 2005.
[Non-Patent Document 3] Hattori, Yamauchi, Nakano, "Broadband Oval Ring Antenna Third Report," General Assembly of IEICE, B-1-165, Tokyo (Kokushikan University), March in 2006.

In the broadband antenna devices disclosed in Patent Documents 1 through 3, the plane radiation conductor stands on the surface of the plane conductor bottom plate in the direction crossing the plane conductor bottom plate. Therefore, the profile of the broadband antenna device becomes great.

In the meantime, the broadband antenna device disclosed in Patent Document 4 presents a problem of a narrow operable band. The antenna for UWB purpose described in Patent Document 5 also presents a problem of a narrow operable frequency band ranging from about 4 GHz to 9 GHz.

The broadband oval ring antennas described in Non-Patent Documents 1 through 3 cover the UWB ranging from 3.1 GHz to 10.6 GHz. However, in such a broadband oval ring antenna, the height of the antenna determines an operating frequency; hence, the height requires about a (quarter) wavelength (about 24 mm) of 3.1 GHz. In order to reduce the height, miniaturizing an antenna by use of a high dielectric substance (ceramic, or the like) is conceivable. However, even when an attempt is made to pursue miniaturization as mentioned above, the height comes to about 10 mm in many cases.

SUMMARY

It is therefore one advantageous aspect of the invention to provide a low-profile, thin antenna element that can cover operation frequency ranges of a UWB (a full-band from 3.1 GHz to 10.6 GHz).

According to one aspect of the invention, there is provided an antenna element, comprising:

a conductive plate, adapted to be electrically connected to an electric ground, and comprising:

a first edge;

a second edge opposing the first edge and formed with a first slit elongated in a first direction;

a third edge intersecting the first edge;

a recessed part intersecting the first edge and the third edge; and a conductive member, elongated from the second edge in the first direction.

The antenna element may be configured such that: a part of the third edge is adapted to serve as a power feeding point which is electrically connected to a power source; and the part of the third edge is closer to the first edge than the first slit.

The antenna element may be configured such that: the second edge is formed with a second slit; the first slit is located between the third edge and the second slit; and the part of the third edge is closer to the first edge than the second slit.

The antenna element may be configured such that: the first slit has a first dimension in the first direction and a second dimension in a second direction perpendicular to the first direction; and the second slit has a third dimension in the first direction which is smaller than the first dimension, and a fourth dimension in the second direction which is larger than the second dimension.

The antenna element may be configured such that: a first section, adapted to be electrically connected to the electric ground, and having a firs dimension in a second direction perpendicular to the first direction; a second section, having a second dimension in the second direction which is shorter than the first dimension; a connecting section, connecting the first section and the second section; and the conductive member is elongated from the connecting section.

The antenna element may be configured such that: the first section opposes the second section across a gap formed by the connecting section.

The antenna element may be configured such that: the connecting section is angled from the first section and the second section.

According to one aspect of the invention, there is provided an antenna element, comprising:

a power source;

an electric ground;

a conductive plate, electrically connected to the electric ground, and comprising;

a first edge;

a second edge opposing the first edge and formed with a first slit elongated in a first direction;

a third edge intersecting the first edge;

a recessed part intersecting the first edge and the third edge; and a conductive member, elongated from the second edge in the first direction, wherein:

a part of the third edge is adapted to serve as a power feeding point which is electrically connected to the power source; and the part of the third edge is closer to the first edge than the first slit.

DETAILED DESCRIPTION OF EXEMPLIFIED EMBODIMENTS

An embodiment of the present invention will be described in detail hereunder by reference to the drawings An antenna element 10 of an embodiment of the present invention is described by reference to FIGS. 1 through 4. In FIGS. 1 through 4, a lateral direction (a widthwise direction or a horizontal direction) is represented by the direction of an X-axis; a longitudinal direction (a depthwise direction or a thicknesswise direction) is represented by the direction of an Y-axis; and a vertical direction (a heightwise direction or a vertical direction) is represented by the direction of a Z-axis.

Figure 1:
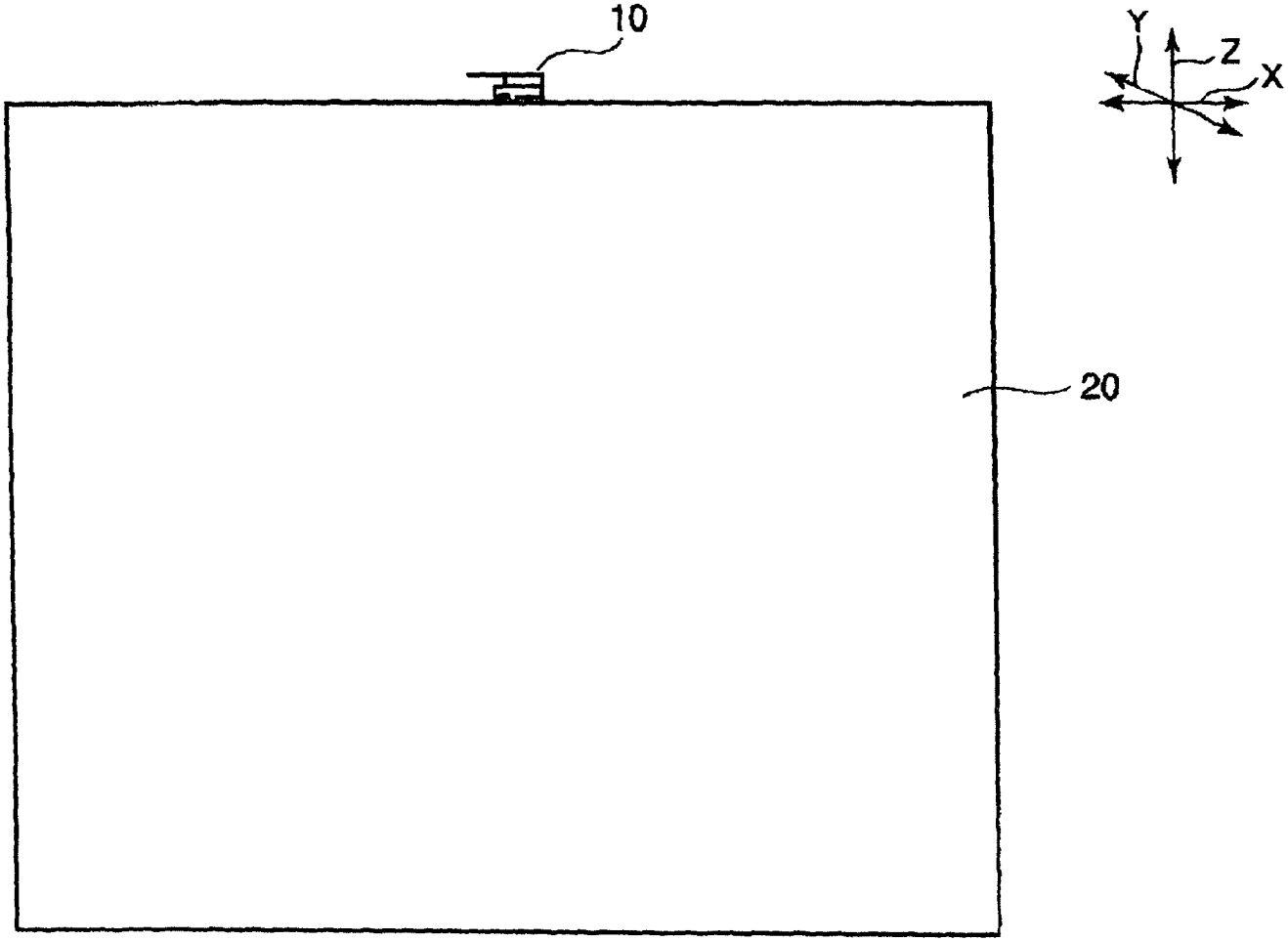
FIG. 1 is a view showing a model having an antenna element according to a one embodiment of the invention attached to the liquid crystal section of a notebook personal computer.

As shown in FIG. 1, the antenna element 10 is disposed at the center of an upper edge of a conductor plate (a ground plate) 20. The antenna element 10 is electrically connected to a feeding section 13 provided on the conductor plate 20. The location of the feeding section 13 (i.e., a feeding position) will be described later.

Figure 2:
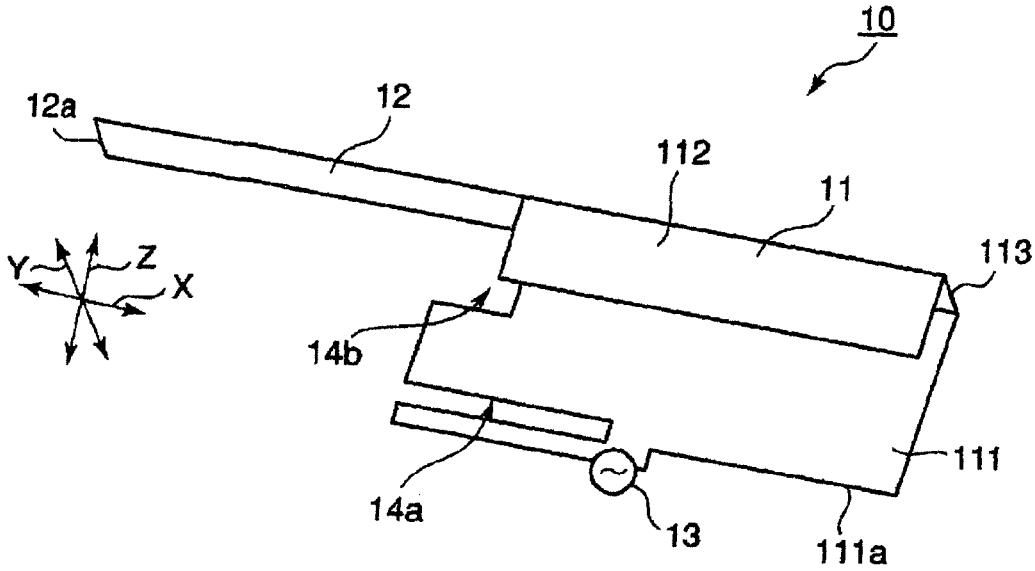
FIG. 2 is a perspective view of an antenna element shown in FIG. 1.

As shown in FIG. 2, the illustrated antenna element 10 has a folded-plate-like antenna section 11 having a C-shaped cross section and a conductor element 12 that is extended from the folded-plate-like antenna section 11 as will be described later. The folded-plate-like antenna section 11 is also called a sheet-shaped antenna. The folded-plate-like antenna section 11 is folded in order to operate at a frequency in a low frequency range with a reduction in height.

The illustrated antenna element 10 can be manufactured by punching and bending a single sheet of metal.

The illustrated folded-plate-like antenna section 11 has a first conductor plate 111 having a first length Lz1 in the direction of the Z-axis and a first width Wx1 in the direction of the X-axis; a second conductor plate 112 positioned in parallel to the first conductor plate 111; and a joint plate 113 that connects one end of the first conductor plate 111 to one end of the second conductor plate 112 (both ends are distant from the ground plate 20).

Figure 3:
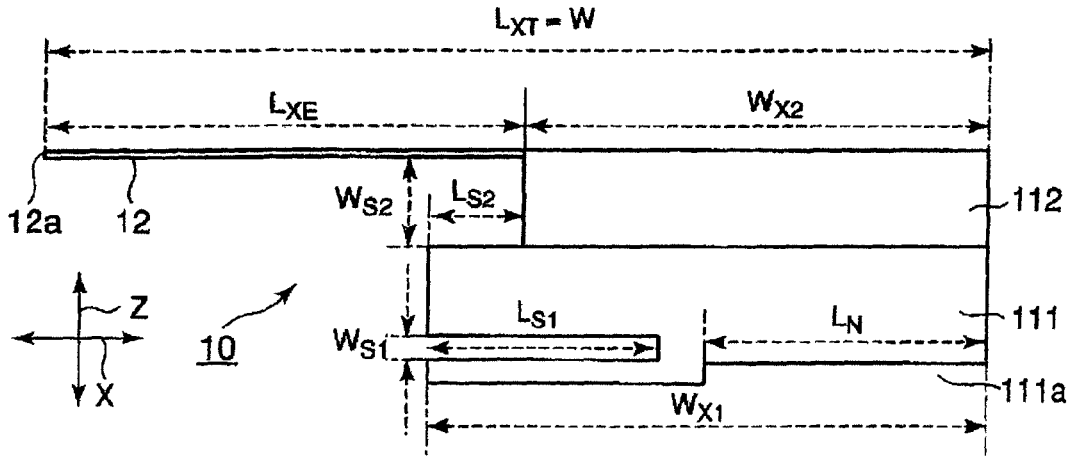
FIG. 3 is a front view of an antenna element shown in FIG. 2.
Figure 4:
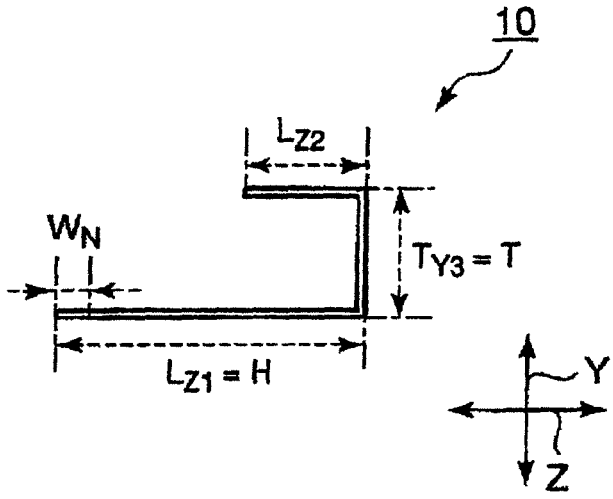
FIG. 4 is a right side view of an antenna element shown in FIG. 2.

As shown in FIGS. 3 and 4, the second conductor plate 112 has a second length Lz2 that is shorter than a first length Lz1 in the direction of the Z-axis. Provided that a wavelength equivalent to a frequency 3.1 GHz is expressed as $\lambda_{3.1}$, the first length Lz1 is $0.052\lambda_{3.1}$, and the second length Lz2 is $0.021\lambda_{3.1}$. The second conductor plate 112 has a second width Wx2 that is shorter than the first width Wx1 in the direction of the X-axis. In the illustrated example, the first width Wx1 is $0.124\lambda_{3.1}$, and the second width Wx2 is $0.103\lambda_{3.1}$. The joint plate 113 has a length (width) $T_{Y3}$ in the direction of the Y-axis and a length (width) equal to the second width Wx2 in the direction of the X-axis. In the illustrated embodiment, the length (thickness) $T_{Y3}$ is $0.021\lambda_{3.1}$.

The conductor element 12 extends from the joint plate 113 in a direction (the lateral direction X) in which the joint plate 113 stretches. The conductor element 12 has a length (thickness) equal to the length (thickness) $T_{Y3}$ of the joint plate 113 in the direction of the Y-axis and an element length $L_{XE}$ in the direction of the X-axis. In the illustrated embodiment, the element length $L_{XE}$ is $0.103\lambda_{3.1}$. Accordingly, a total length $L_{XT}$ that is the sum of the length (width) Wx2 of the joint plate 113 in the direction of the X-axis and the element length $L_{XE}$ of the conductor element 12 is equal to $0.207\lambda_{3.1}$.

In the illustrated embodiment, the first conductor plate 111 has a notch 111*a* on the right side of a leading end of the conductor plate (an end on the part of the conductor plate opposing the ground plate 20). In the present embodiment, the right edge of the folded-plate-like antenna section 11 is called a first edge, and the left edge of the same is called a second edge. Accordingly, the notch 111*a* is formed in the first edge of the leading end of the first conductor plate 111. In the meantime, the conductor element 12 extends from the second edge of the joint plate 113. In the illustrated embodiment, the notch 111*a* has a length $L_N$ of $0.062\lambda_{3.1}$ and a width $W_N$ of $0.052\lambda_{3.1}$.

As mentioned above, the notch 111*a* is formed in the first conductor plate 111 in order to enhance a frequency characteristic of only the folded-plate-like antenna section 11.

As is obvious from FIGS. 2 through 4, the antenna element 10 is housed in a space defined by a virtual rectangular parallelepiped having a predetermined width W in the direction of the X-axis, a predetermined thickness T in the direction of the Y-axis, and a predetermined height H in the direction of the Z-axis. In the illustrated embodiment, the predetermined width W is $0.207\lambda_{3.1}$ that is equal to the total length $L_{XT}$. The predetermined thickness T is $0.021\lambda_{3.1}$ that is equal to the length (thickness) $T_{Y3}$ of the joint plate 113. The predetermined height H is $0.052\lambda_{3.1}$ that is equal to the first length $L_{Z1}$ of the first conductor plate 111.

As shown in FIG. 2, the first conductor plate 111 has the feeding section 13 at a predetermined location on the leading end. In the illustrated embodiment, the feeding position of the feeding section 13 is situated at a position that is separated from the first edge of the first conductor plate 111 by $0.072\lambda_{3.1}$. Put another way, the feeding position of the feeding section 13 is a location that is separated from the second edge of the first conductor plate 111 by $0.052\lambda_{3.1}$.

A leading end 12*a* of the conductor element 12 is situated at a location that is most distant from the feeding section 13 in the heightwise direction Z of the virtual rectangular parallelepiped.

In the illustrated antenna element 10, the folded-plate-like antenna section 11 covers a first frequency band (a high frequency range), and the conductor element 12 covers a second frequency band (a low frequency range) that is lower than the first frequency band.

Specifically, the height H and the thickness T of the folded-plate-like antenna section 11, the second length Lz2 of the second conductor plate 112, and the feeding position of the feeding section 13 are adjusted in such a way that a wide band is achieved when the folded-plate-like antenna section 11 is set on the conductor plate (the ground plate) 20. The conductor element 12 that operates in a second frequency band (3.1 GHz to 5 GHz in this case) which cannot be covered by the folded-plate-like antenna section 11 is provided in the folded-plate-like antenna section 11.

In the present invention, in order to enhance a VSWR frequency characteristic of the antenna element 10 achieved in the vicinity of 3.1 GHz, at least one slit is formed in the second edge surface of the first conductor plate 111.

In the illustrated embodiment, the first slit 14*a* and the second slit 14*b* are provided as slits. The first slit 14*a* is provided at a position on the leading end of the first conductor plate 111 (close to the feeding section 13) that is closer to the second edge than to the feeding section 13. In the meantime, the second slit 14*b* is provided at a position on the first conductor plate 111 that is close to the joint plate 113 and closer to the second edge than to the feeding section 13.

As shown in FIG. 3, the first slit 14*a* has a first slit width $W_{S1}$ and a first slit length $L_{S1}$. The second slit 14*b* has a second slit width $W_{S2}$ and a second slit length $L_{S2}$. The first slit width $W_{S1}$ is narrower than the second slit width $W_{S2}$, and the first slit length $L_{S1}$ is longer than the second slit length $L_{S2}$. Specifically, the first slit 14*a* is a long slender slit, whilst the second slit 14*b* is a short thick slit. In the illustrated embodiment, the first slit width $W_{S1}$ is $0.05\lambda_{3.1}$, and the first slit length $L_{S1}$ is $0.052\lambda_{3.1}$. The second slit width $W_{S2}$ is $0.021\lambda_{3.1}$, and the second slit length $L_{S2}$ is $0.021\lambda_{3.1}$.

Figure 5:
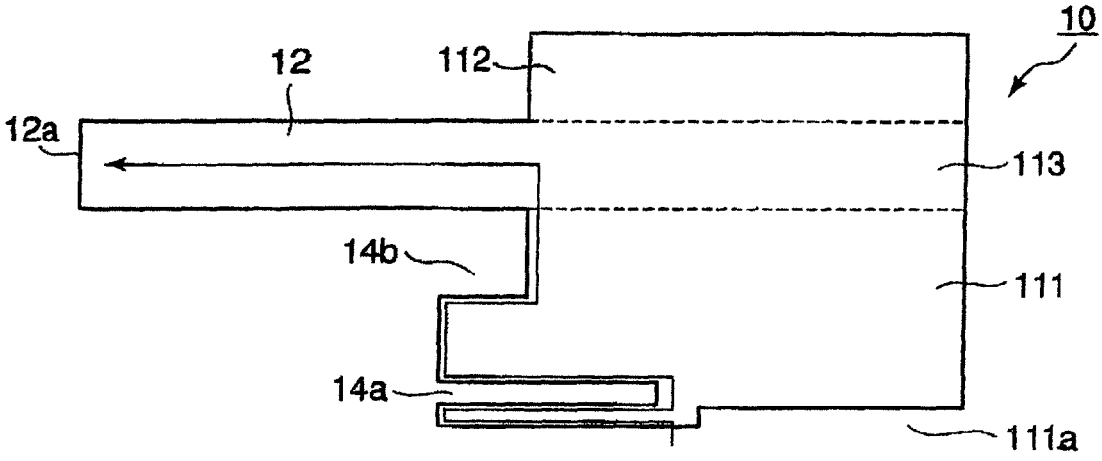
FIG. 5 is a view showing a development elevation of an antenna element shown in FIG. 2 and a operation image (a current distribution) achieved at a frequency of 3.1 GHz.

In FIG. 5, a distance from the feeding section 13 to the leading end 12*a* of the conductor element 12 is about 0.28 times (i.e., $0.28\lambda_{3.1}$) of the wavelength λ3.1 achieved at 3.1 GHz by means of passing through the first and second slits 14*a* and 14*b*. As a result, the antenna element 10 assumes a shape by means of which the element operates in a low range.

The shape of the antenna element 10 is optimized in consideration of the fact that the antenna element is provided in the liquid-crystal section of the notebook personal computer.

Figure 6:
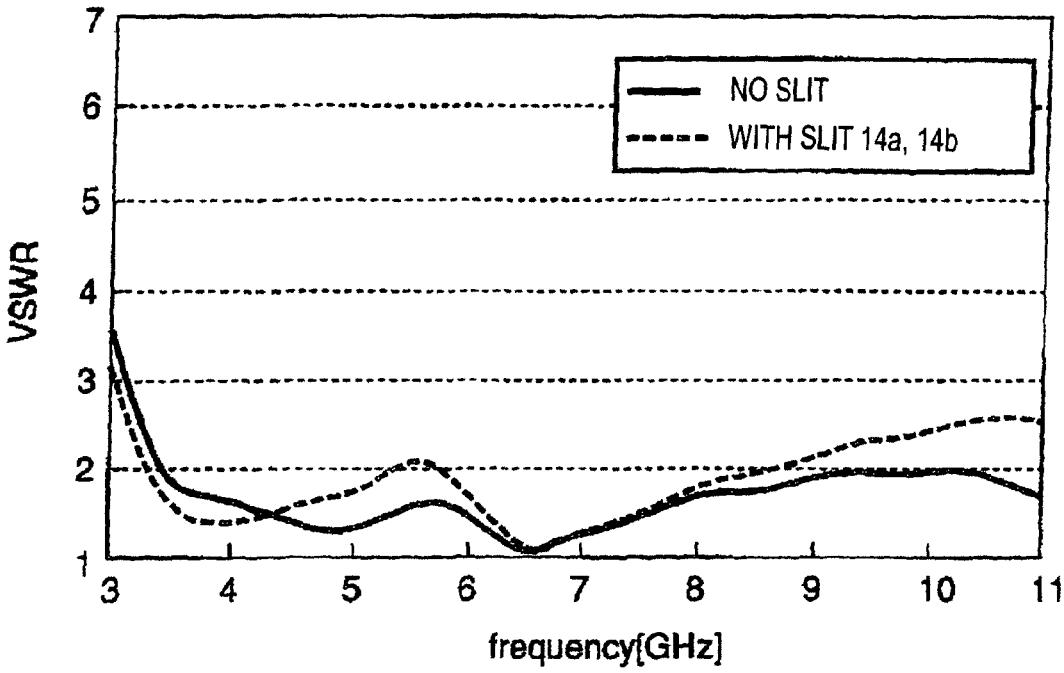
FIG. 6 is a view showing a VSWR frequency characteristic of an antenna element shown in FIG. 2.

In FIG. 6, the horizontal axis represents a frequency [GHz], and the vertical axis represents a VSWR. FIG. 6 shows a VSWR frequency characteristic of a slitless antenna element and a VSWR frequency characteristic of the antenna element 10 having the first and second slits 14*a* and 14*b*.

As is obvious from FIG. 6, it is seen that the VSWR characteristic achieved in a low range is enhanced as a result of provision of the first and second slits 14*a* and 14*b* while deterioration of the wideband characteristic is prevented. Specifically, the antenna element 10 of the present embodiment can enhance the VSWR characteristic of the antenna element 10 achieved in the low range by provision of the slits 14*a* and 14*b* while making use of a characteristic of the broadband antenna built from the folded-plate-like antenna section 11 and the conductor element 12.

The way the VSWR frequency characteristic of the antenna element changes according to the locations of the slits will now be described.

Figure 7:
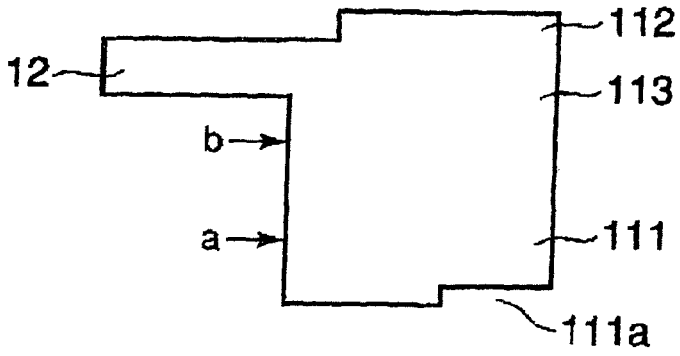
FIG. 7 is a development elevation of an antenna element whose slit positions are defined.

In FIG. 7, a position "a" designates the location of a leading-end part of the first conductor plate 111 (the feeding section 13), and a position "b" designates the location of a part of the first conductor plate 111 close to the joint plate 113.

Figure 8:
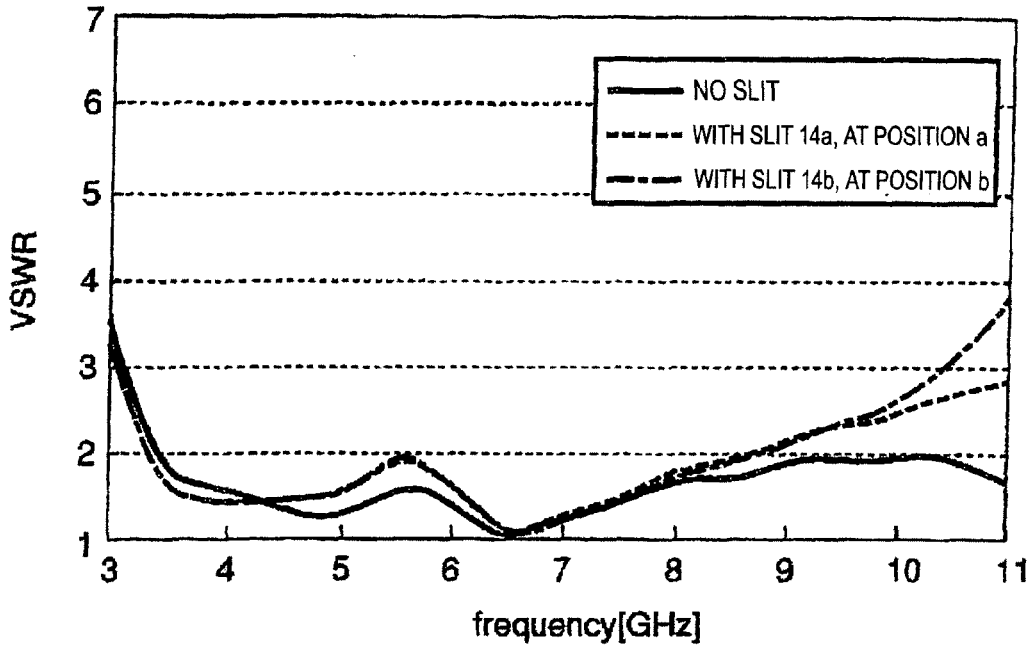
FIG. 8 is a view showing a change of a VSWR frequency characteristic of antenna element according to respective locations of a first slit.

In FIG. 8, the horizontal axis represents a frequency [GHz], and the vertical axis represents a VSWR. FIG. 8 shows a VSWR frequency characteristic of a slitless antenna element, a VSWR frequency characteristic of the antenna element having the first slit 14*a* provided at the position "a," and a VSWR frequency characteristic of the antenna element having the first slit 14*a* provided at the position "b."

As is obvious from FIG. 8, it is understood that the VSWR characteristic of the antenna element achieved in a low range can be enhanced by provision of the first slit 14*a* regardless of the location of the slit. Further, it is understood that deterioration of the VSWR characteristic of the antenna element achieved at 10 GHz can be prevented by providing the first slit 14*a* at the position "a" (i.e., a location close to the feeding section 13) rather than at the position "b" (the location close to the joint plate 113).

Figure 9:
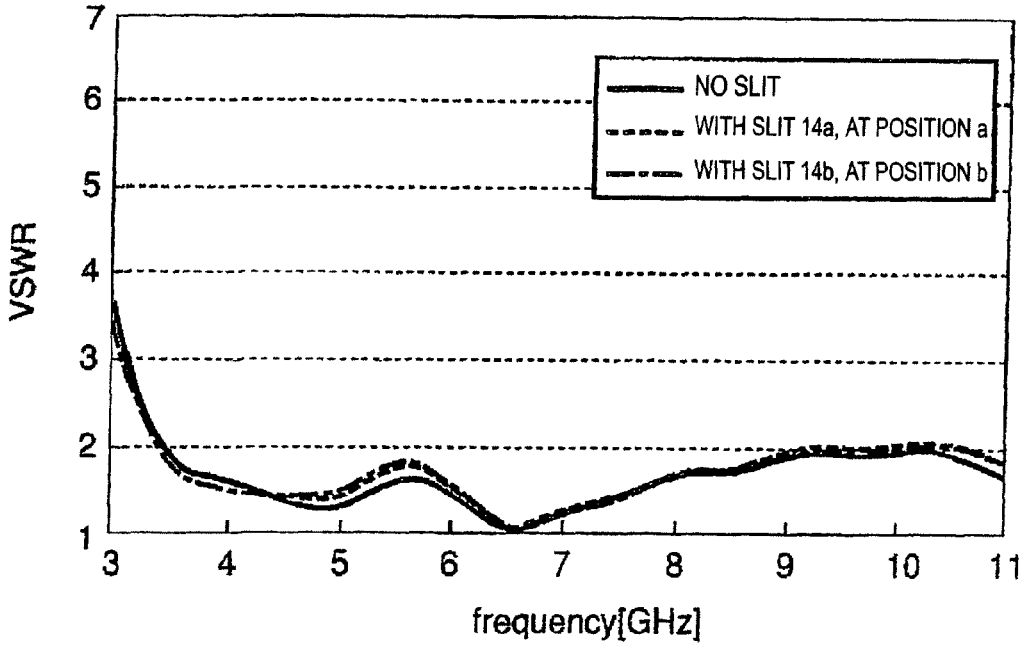
FIG. 9 is a view showing a change of a VSWR frequency characteristic of antenna element according to respective locations of a second slit.

In FIG. 9, the horizontal axis represents a frequency [GHz], and the vertical axis represents a VSWR. FIG. 9 shows a VSWR characteristic of a slitless antenna element, a VSWR characteristic of an antenna element having the second slit 14*b* provided at position "a," and a VSWR characteristic of an antenna element having the second slit 14*b* provided at position "b."

As is obvious from FIG. 9, it is understood that the VSWR characteristic of the antenna element achieved in the low range can be slightly enhanced by providing the first slit 14*a* regardless of a location where the slit is to be provided.

It is understood from FIGS. 8 and 9 that the VSWR characteristic of the antenna element achieved in the low range can be enhanced by providing at least one slit. When the first slit 14*a* and the second slit 14*b* are provided together, the first slit 14*a* is provided at the position "a" (i.e., a position close to the feeding section 13), and the second slit 14*b* is provided at the position "b" (i.e., a position close to the joint plate 113), as in the antenna element 10 shown in FIG. 2. Thus, the VSWR characteristic of the antenna element achieved in a low range can be enhanced while deterioration of the VSWR characteristic arising at 10 GHz is prevented as indicated by the VSWR frequency characteristic of the antenna element 10 shown in FIG. 6.

The way the VSWR frequency characteristic of the antenna element changes according to the slit length SI of the slit and a location where the slit is provided will now be described.

Figure 10:
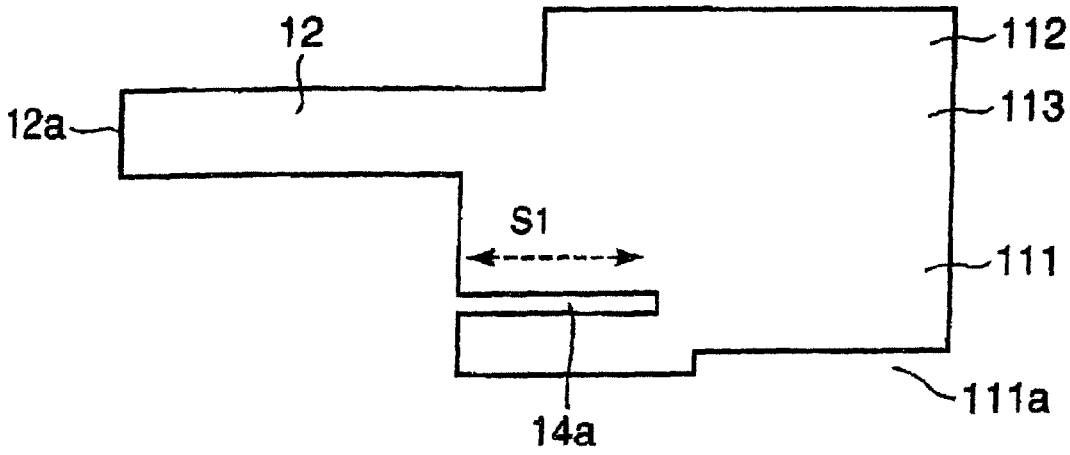
FIG. 10 is a development elevation of an antenna element whose slit length of a slit is defined.

In FIG. 10, an embodiment of an antenna element with one slit 14*a* having a slit width of $0.005\lambda_{3.1}$ is shown here.

Figure 11:
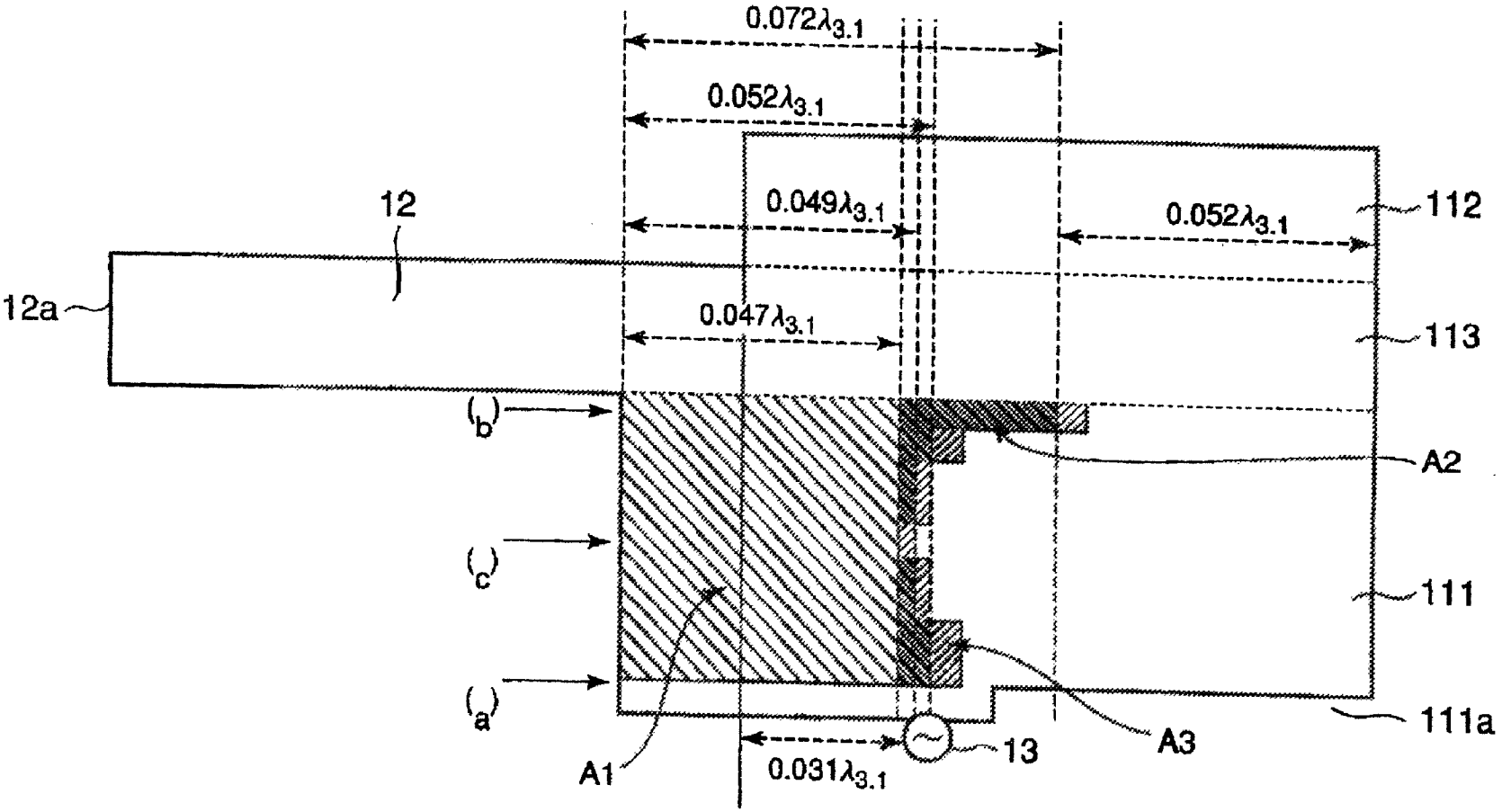
FIG. 11 is a development elevation of an antenna element having a defined location where a single slit having a slit width of $0.005\lambda_{3.1}$ is provided.

In FIG. 11, a position (a) designates the location of a leading-end part of the first conductor 111 (the feeding section 13); a position (b) designates the location of a part of the first conductor plate 111 close to the joint plate 113; and a position (c) designates an essential center of the first conductor plate 111.

Figure 12A:
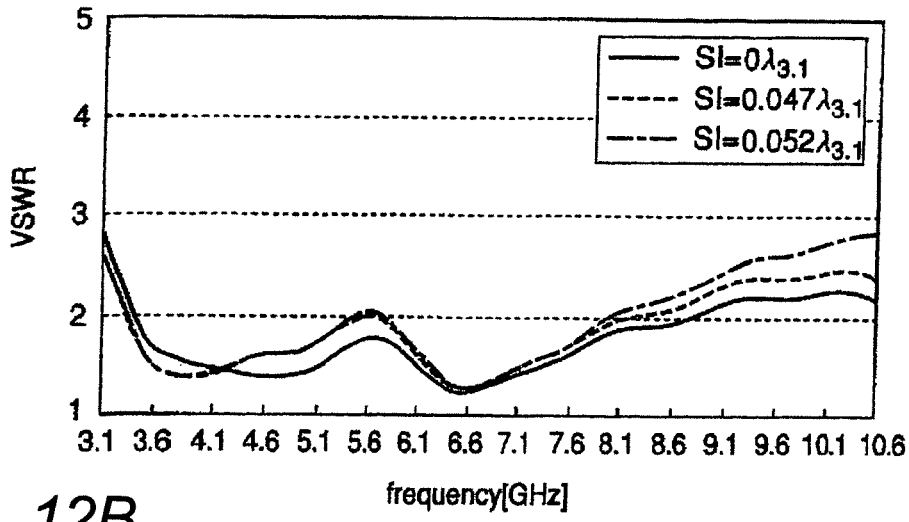
FIG. 12A is a view showing a change of a VSWR frequency characteristic of antenna element whose first slit is provided at position (a) according to respective slit lengths.
Figure 12B:
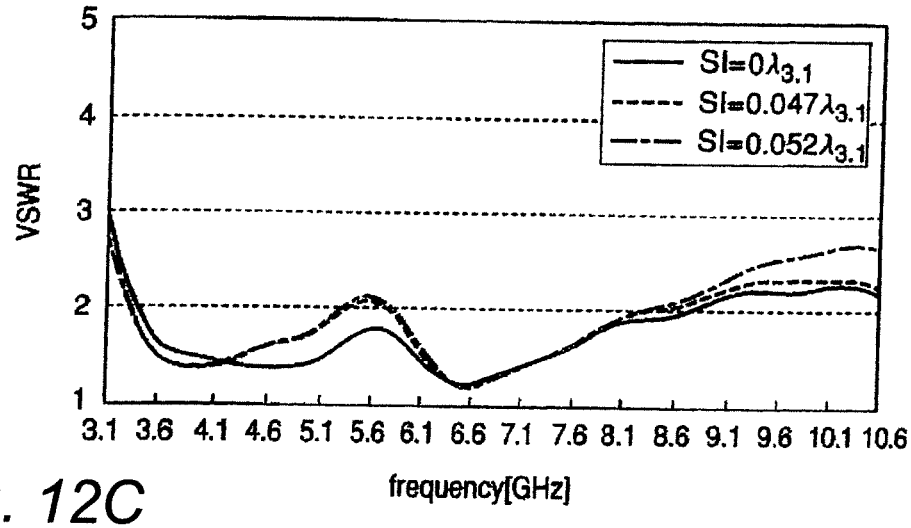
FIG. 12B is a view showing a change of a VSWR frequency characteristic of antenna element whose first slit is provided at position (b) according to respective slit lengths.
Figure 12C:
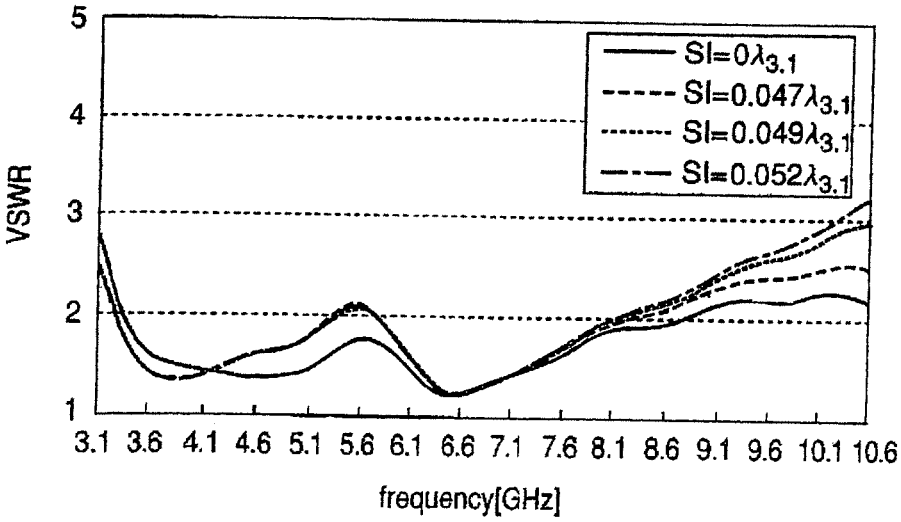
FIG. 12C is a view showing a change of a VSWR frequency characteristic of antenna element whose first slit is provided at position (c) according to respective slit lengths.

FIGS. 12A to 12C are views showing changes arising in the VSWR frequency characteristic of the antenna element according to the location where the slit 14*a* is provided and the slit length SI. In FIGS. 12A, 12B, and 12C, the horizontal axis represents a frequency [GHz], and the vertical axis represents a VSWR.

Each of FIGS. 12A and 12B show VSWR frequency characteristics of the antenna elements having a slit length SI of $0\lambda_{3.1}$ (i.e., no slit), a slit length SI of $0.047\lambda_{3.1}$, and a slit length SI of $0.052\lambda_{3.1}$. FIG. 12C shows VSWR frequency characteristics of the antenna elements having a slit length SI of $0\lambda_{3.1}$ (i.e., no slit), a slit length SI of $0.047\lambda_{3.1}$, a slit length SI of $0.049\lambda_{3.1}$, and a slit length SI of $0.052\lambda_{3.1}$.

FIG. 12A shows that the VSWR characteristic of the antenna element achieved in a low band can be enhanced as a result of provision of the slit 14*a* at the position (a) (i.e., a location close to the feeding section 13) when compared with the case where the slit 14*a* is not provided (SI=$0\lambda_{3.1}$). Further, it is seen that deterioration of the VSWR characteristic of the antenna element achieved at 10 GHz can be prevented in the case of a slit length Si of $0.047\lambda_{3.1}$ than in the case of a slit length SI of $0.052\lambda_{3.1}$.

FIG. 12B shows that the VSWR characteristic of the antenna element achieved in a low band can be enhanced as a result of provision of the slit 14*a* at the position (b) (i.e., a location close to the joint plate 113) when compared with the case where the slit 14*a* is not provided (SI=$0\lambda_{3.1}$). Further, it is seen that deterioration of the VSWR characteristic of the antenna element achieved at 10 GHz can be prevented in the case of a slit length SI of $0.047\lambda_{3.1}$ than in the case of a slit length SI of $0.052\lambda_{3.1}$.

FIG. 12C shows that the VSWR characteristic of the antenna element achieved in a low band can be enhanced as a result of provision of the slit 14*a* at the position (c) (i.e., an essential center of the first conductor plate 111) when compared with the case where the slit 14*a* is not provided (SI=$0\lambda_{3.1}$). Further, it is seen that deterioration of the VSWR characteristic of the antenna element achieved at 10 GHz can be prevented as the slit length SI becomes shorter (i.e., deterioration can be prevented in the case of a slit length SI of $0.049\lambda_{3.1}$ than in the case of a slit length SI of $0.052\lambda_{3.1}$, and deterioration can be prevented in the case of a slit length SI of $0.047\lambda_{3.1}$ than in the case of a slit length SI of $0.049\lambda_{3.1}$).

FIG. 11 shows the slit length SI of the slit 14*a* and areas in the location of the slit 14*a* where the VSWR characteristic of the antenna element is different. The VSWR characteristic of the antenna element is different according to divided first through third areas A1, A2, and A3. The first area A1 shows an area where the VSWR characteristic of the antenna element is less deteriorated around 10 GHz. The second area A2 shows an area where the VSWR characteristic of the antenna element is deteriorated around 1 GHz and where a VSWR falls within a range from 2.5 to 3. The third area A3 shows an area where the VSWR of the antenna element assumes a value of three around 10 GHz.

FIG. 11 shows that the influence of 10 GHz (a high frequency) is small even in the case of a long slit length SI when the slit 14*a* is provided at the position (a) (i.e., the area close to the feeding section 13) or the position (b) (i.e., the area close to the joint plate 113) than at the position (c) (i.e., the an essential center of the first conductor plate 11). When the leading end of the slit 14*a* extends toward the first edge in excess of the feeding section 13, sharp deterioration is understood to arise in the VSWR characteristic. Accordingly, providing the slit at a position close to the second edge than to the feeding section 13 is preferable.

Specifically, at the position (b), the VSWR characteristic comes to three or less even when the slit length SI is made long to $0.072\lambda_{3.1}$ at a slit width of $0.005\lambda_{3.1}$. Moreover, in a case where the slit is moved toward the position (c) by an amount corresponding to one slit, the VSWR characteristic comes to three or less even when the slit length SI is made longer to $0.052\lambda_{3.1}$. Even when the slit is further moved toward the position (c) by an amount corresponding to the width of two slits and when the slit length SI is made longer to $0.049\lambda_{3.1}$, the VSWR characteristic comes to three or less; the slit length SI achieved at the position (c) comes to $0.047\lambda_{3.1}$; and the VSWR characteristic comes to three or less.

Even when the slit moves from the position (c) toward the position (a) and when the slit length SI is made longer to $0.049\lambda_{3.1}$ by an amount corresponding to the width of two slits, the VSWR characteristic comes to three or less. Even when the slit is further moved toward the position (a) and when the slit length SI is made longer to $0.052\lambda_{3.1}$ by an amount corresponding to the width of two slits; namely, the position (a), the VSWR characteristic comes to three or less.

Although the preferred embodiment of the present invention has been described, the present invention is naturally not limited to the foregoing embodiment. For instance, the number of slits is not limited to two. Further, the slit is not limited to a straight (a rectangular) shape, and slits of various shapes may also be adopted. Further, the direction in which the slits extend is not limited to the lateral direction, and the slits may also be extended in an oblique direction. The sheet-shaped antenna 11 may also assume a shape other than the square shape. Specifically, the antenna 11 may also be a broadband sheet-shaped monopole assuming a circular shape, a ring shape, the shape of a home base, and the shape of a sector, as long as the antenna 11 includes the first edge, the second edge and the leading end of the first conductor plate 111. The conductor element 12 may also assume a meandering shape. Corners of the antenna element may also be rounded. The antenna 11 may be provided as a planar conductive plate. In other words, St least two of the first conductor plate 111, the second conductor plate 112 and the joint plate 113 may be disposed within the same plane. The conductor element 12 may be elongated from any position in the second edge. The first conductor plate 111 may not be connected directly to an electric ground unless the first conductor plate 111 is electrically connected to the electric ground. The first conductor plate 111 and the second conductor plate 112 may not be parallel with each other. The first conductor plate 111 and the second conductor plate 112 may not be arranged so as to form the U-shaped cross section but may be arranged so as to form a crank-shaped cross section.

What is claimed is:

1. An antenna element, comprising:

a conductive plate, adapted to be electrically connected to an electric ground, and comprising:

a first edge;

a second edge opposing the first edge and formed with a first slit elongated in a first direction;

a third edge, at which a power feeding point configured to feed power to the conductive plate is provided, and which intersects the first edge;

a recessed part intersecting the first edge and the third edge;

a first section, including the third edge, having a first dimension in a second direction perpendicular to the first direction, and in which the first slit is formed;

a second section, having a second dimension in the second direction which is shorter than the first dimension; and a connecting section, connecting the first section and the second section; and a conductive member, elongated from the second edge of in the connecting section in the first direction, wherein the conductive plate is configured to receive a first frequency band so as to cover the first frequency band by cooperation of the first section, the connecting section, and the second section, wherein the conductive member is configured to receive a second frequency band in cooperation with the first section, wherein the second frequency band is lower than the first frequency band.

2. The antenna element as set forth in claim 1, wherein:

the power feeding point is closer to the first edge than the first slit.

3. The antenna element as set forth in claim 2, wherein:

the second edge is formed with a second slit;

the first slit is located between the third edge and the second slit; and the part of the third edge is closer to the first edge than the second slit.

4. The antenna element as set forth in claim 3, wherein:

the first slit has a third dimension in the first direction and a fourth dimension in a second direction perpendicular to the first direction; and the second slit has a fifth dimension in the first direction which is smaller than the third dimension, and a sixth dimension in the second direction which is larger than the fourth dimension.

5. The antenna element as set forth in claim 1, wherein:

the conductive plate is bent so that the first section opposes the second section across a gap formed by the connecting section.

6. The antenna element as set forth in claim 1, wherein:

the connecting section is angled from the first section and the second section.

7. An antenna device, comprising:

a power source;

an electric ground;

a conductive plate, electrically connected to the electric ground, and comprising:

a first edge;

a second edge opposing the first edge and formed with a first slit elongated in a first direction;

a third edge, at which a power feeding point configured to feed power from the power source to the conductive plate is provided, and which intersects the first edge;

a recessed part intersecting the first edge and the third edge; and a first section, including the third edge, having a first dimension in a second direction perpendicular to the first direction, and in which the first slit is formed;

a second section, having a second dimension in the second direction which is shorter than the first dimension; and a connecting section, connecting the first section and the second section; and a conductive member, elongated from the second edge of in the connecting section in the first direction, wherein the power feeding point is closer to the first edge than the first slit, wherein the conductive plate is configured to receive a first frequency band so as to cover the first frequency band by cooperation of the first section, the connecting section, and the second section, wherein the conductive member is configured to receive a second frequency band in cooperation with the first section wherein the second frequency band is lower than the first frequency band.

* * * * *